United States Patent [19]

Kusche

[11] 3,955,526

[45] May 11, 1976

[54] COWL APPARATUS FOR OUTBOARD MOTORS

[75] Inventor: David W. Kusche, Oshkosh, Wis.

[73] Assignee: Brunswick Corporation, Skokie, Ill.

[22] Filed: Sept. 6, 1975

[21] Appl. No.: 503,746

[52] U.S. Cl. ..... 115/17; 123/195 P

[51] Int. Cl.[2] ..... B63H 21/26

[58] Field of Search ..... 115/17; 123/195 P, 198 E; 180/69 R

[56] References Cited

UNITED STATES PATENTS

| | | | |
|---|---|---|---|
| 2,224,900 | 12/1940 | Conover | 123/195 P |
| 2,676,559 | 4/1954 | Davies | 123/195 P |
| 3,358,668 | 12/1967 | Post et al. | 115/17 |
| 3,773,010 | 11/1973 | Elingsen | 115/17 |

*Primary Examiner*—Duane A. Reger
*Assistant Examiner*—Stuart M. Goldstein
*Attorney, Agent, or Firm*—Andrus, Sceales, Starke & Sawall

[57] ABSTRACT

An outboard motor cowl includes separate starboard and port cowl members which are each individually, removably hinged to the rear of the engine by a pair of spaced hinge units which allow separate attachment and removal of the cowl halves. The forward ends of the cowl members are releasably connected to separate and independent mounts. The uppermost aft hinge unit is visible from the front of the motor. Each hinge unit includes a receptacle secured to a mounting plate and a hinge pin secured to the inside of the cowl member in slightly spaced relation to the aft edge. The receptacle is spaced from a back edge sealing bracket and includes a guide member to receive and guide the cowl member. The top hinge pin is longer than the lowermost pin and serves to pilot the lower pin into the proper position. The hinge receptacle and pin support include interfering members which hold the cowl downward in the normal closed position, and require slight pivotal movement of the cowl to release the hold-down members. The front of the cowl members is suspended by a cowl pin which engages an oval shaped ring as the cowl member is pivoted to the closed position. The lower ring is secured to a front bracket plate having resilient clamping pads on the ends which cooperate with similar resilient clamping pads in the adjacent cowl to support the throttle cable to one side and the gas line to the opposite side.

29 Claims, 18 Drawing Figures

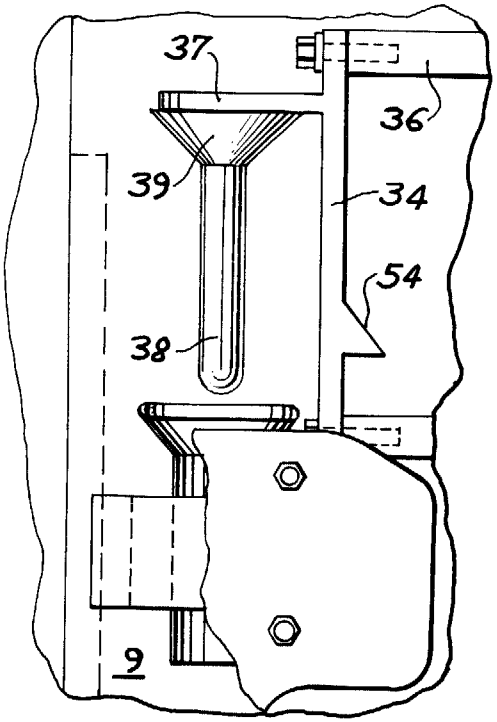
Fig. 14
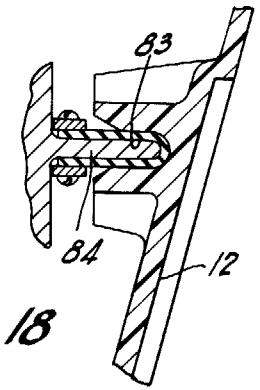
Fig. 18
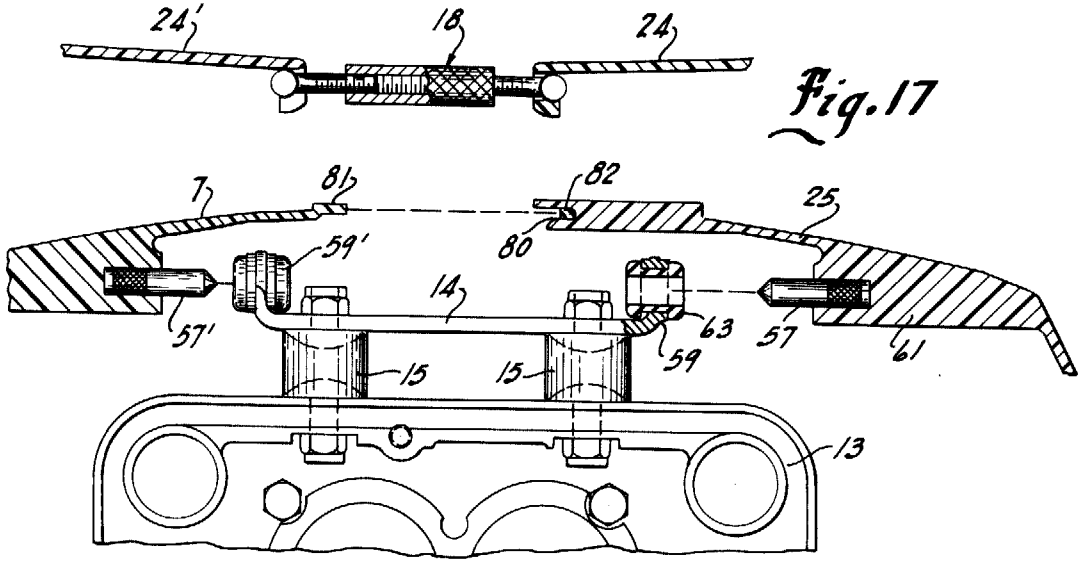
Fig. 17
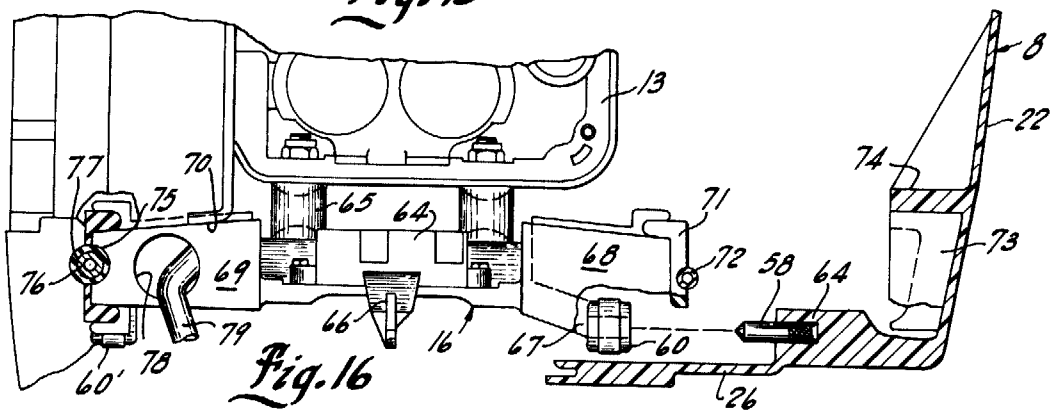
Fig. 15
Fig. 16

COWL APPARATUS FOR OUTBOARD MOTORS

BACKGROUND OF THE INVENTION

This invention relates to the cowl for outboard motors and particularly to an improved multiple piece cowl for enclosing the internal combustion engine of an outboard motor.

Outboard motors includes an upper power or drive head assembly supported upon the upper end of a drive shaft and exhaust housing with a dependent propeller unit. The outboard motor is secured to the boat transom by a suitable swivel bracket assembly with tilting movement of the unit about a generally horizontal axis as well as steering movement about a generally vertical axis. The internal combustion engine is located above the transom and constitutes a noise source. A cowl is provided which encloses the upper end of the drive unit and which is suitably constructed and mounted to reduce the noise output and project the occupants from any contact with the engine. The cowl, for example, is preferably mounted in an isolated manner, for example, as shown in U.S. Pat. No. 3,358,668 to minimize the transmission of engine vibration to the cowl thereby further minimizing the noise transmission. In many instances and particularly for small outboard motors, an integral single piece cowl may be employed because the relatively small size is adapted to installation and removal. For larger horsepower outboard motors, a clam-shell cowl has been developed such as shown in U.S. Pat. No. 3,773,010 to more conveniently permit accessability of engine components as well as to more readily permit installation and removal of the cowl. In such a construction a hinge structure interconnects the starboard and port cowl sections of the aft end of the engine with the forward ends interconnected by suitable quick release means.

With the increasing size of outboard engines, the one piece cowls and multiple-part interconnected cowls have become difficult to handle, particularly when on-board the boat. The cowls in the prior art structures are normally suspended on the front and aft portions of the engine with suitable forward and rear interlocks to prevent movement of the cowling. In a large horsepower outboard, the on-board operator cannot visually view the aft end of the engine assembly when installing and removing of the cowl structure. Further, the bulkiness and weight of the cowl structure makes it extremely difficult to manipulate and position the cowl structure properly, particularly where it is constructed to relatively closely enclose the engine for aesthetic and noise deadening purposes.

SUMMARY OF THE PRESENT INVENTION

The present invention is particularly directed to an improved cowl apparatus for outboard motors and particularly to relatively large horsepower engines. Generally, in accordance with the present invention, the cowl apparatus includes separate starboard and port cowl members or sections which are individually, removably hinged to the aft end of the engine for separate attachment and removal. The forward end of the cowl sections are releasably connected to separate and independent mounts such that each section may be individually installed and removed. In accordance with a particularly novel aspect of the present invention, the aft hinge pin means includes upper guide means which are visual from the front of the engine to permit the convenient mounting of the individual cowl members from the forward or front of the engine. The hinge pin means further includes interlocking means which automatically move to a latch position in response to pivoting of the cowl half to the closed position.

Each cowl section is suspended at the front end by suitable pin and slot couplings which engage as the section is pivoted to the closed position. The rear hing pin means and front couplings are constructed to vibrationally isolate the cowl end from the power unit.

More particularly, in accordance with a particularly novel and practical construction of the present invention, the cowl members are similarly supported with respect to a relatively small vertical back plate which closes the gap therebetween to seal the aft end of the cowl. Each cowl member is supported by a pair of two or more vertically spaced hinge means, with an uppermost hinge means which is readily visible from the forward end of the outboard motor. In particular, a pain of hinge receptacles may be secured to the aft mounting plate which is resiliently interconnected to the engine block by vibration isolation mounts. A pair of hinge pins are secured to the inside of the cowl member in slightly spaced relation to the aft edge. The hinge receptacles are located with respect to the back sealing plate and include a guide cam member spaced slightly from the back plate. With the cowl raised to align the lower end of the upper hinge pin with the upper end of the topmost receptacle, the unit is moved inwardly with the rearward edge of the cowl adjacent to the sealing plate and moved inwardly along the guide cam member. When it is placed completely inwardly, the pin is essentially aligned with the receptacle and can be dropped downwardly into the upper end thereof for guided movement into the receptacle. The uppermost hinge pin is longer than the lowermost pin. The guided movement of the back edge and the upper pin will automatically pilot the lower pin into the proper position. The cowl member is then pivoted to the closed position and in so moving effects a sealing engagement with the back seal plate. Simultaneously, the hinge receptacle and the hinge pin support on the cover include interfering members which will positively force the cover downwardly to the normal position and prevent upward movement of the apparatus under normal operating conditions.

Generally, the interlock is arranged to require slight pivotal movement of the cover on the hinge pins to release the hold-down means for removal. The forward end of the cowl members are provided with suspension means including pin and socket means to provide vibration isolated mounting of the forward end of the cowl. The forward end of the cowl halves or the front of the cowl halves are locked together with suitable over-center clamp structures. The total forward end is covered with a separate cover member.

In accordance with a further preferred and novel construction and teaching of the present invention, the forward end of the unit includes a conventional silencer plate. An upper hinge suspension member is secured to the upper end of the silencer plate by suitable rubber mounts. A pair of oval shaped locking receptacles are secured to the opposite end of the member and adapted to mate with corresponding lateral projecting pins on the inner surface of the cowl members. The oval shape permits the limited pivotal movement on the rear hinge pins of the cowl members in closing and opening of the cowl. Further, the lower forward end of the cowl members are similarly suspended on a bracket plate secured to the bottom end of the silencer plate. The lower bracket preferably also includes a centrally located front cover release for releasably interconnecting the coupling of the separate front cover in place. In addition, the sides of the laterally extending bracket plate with recessed openings in the lower edges of the cowl members. The opposite ends of the bracket plate are provided with resilient clamping pads which cooperate with similar resilient clamping pads in adjacent portion of the cover. The throttle control cable is clamped to the one side of the bracket plate while the gas line is similarly clamped between the opposite side of the plate. Further, the bracket plate may be provided with a power cable opening for interconnection of the necessary electrical cable line and the like. The front plate structure permits the convenient mounting of the fuel and control cables as well as the ignition wiring harness within an aesthetically pleasing presentation of the engine enclosure.

The present invention provides a novel multiple part cowl assembly particularly adapted for large outboard motors and the like where the size and weight of the cowling has caused the removal and installation to be awkward and difficult.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings:

FIG. 14 is a view illustrating the relative vertical position of the hinge pin in preparation for assembly of the starboard cowl member;

FIG. 15 is an enlarged fragmentary view of the upper front portion of the mounting;

FIG. 16 is a similar enlarged fragmentary view of the lower front mounting assembly;

FIG. 17 is an enlarge fragmentary view showing the hinged structure for interconnecting of the two front members to two cowl members at the front of the engine;

FIG. 18 is an enlarged fragmentary view taken generally on line 18—18 of FIG. 5 and illustrating the interlock between the lower portion of the cowl and the adjacent drive shaft housing.

DESCRITPION OF THE ILLUSTRATED EMBODIMENT

Figure 4:
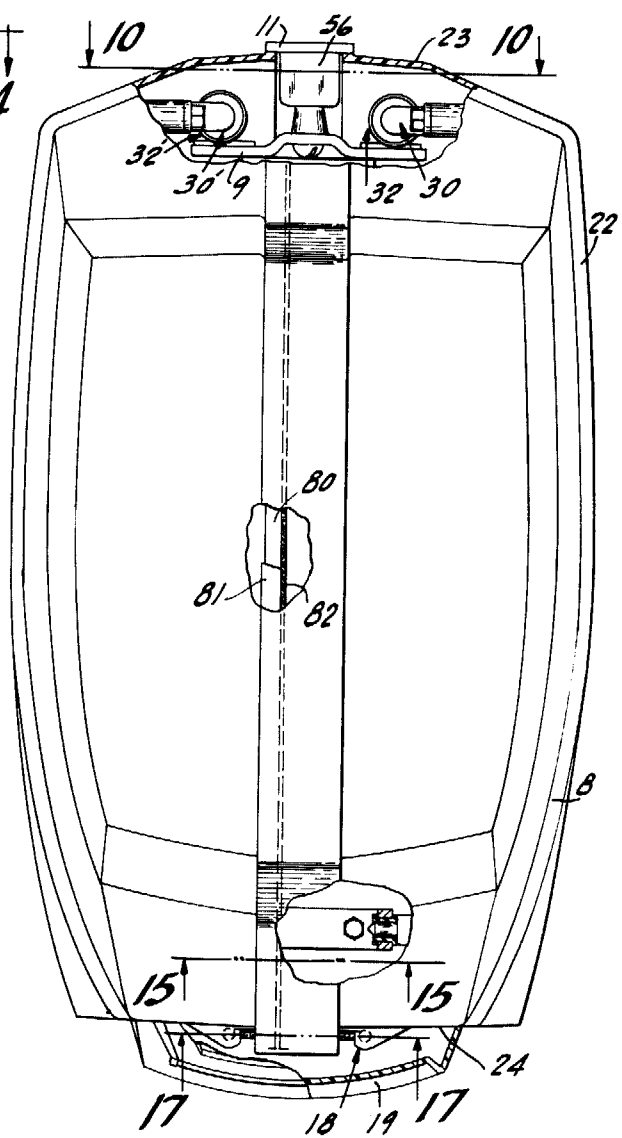
FIG. 4 is an enlarged top elevational view taken generally on line 4—4 of FIG. 2.
Figure 2:
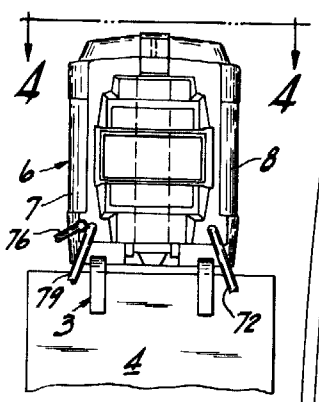
FIG. 2 is a front elevational view taken generally on line 2—2 of FIG. 1 of the outboard motor.
Figure 3:
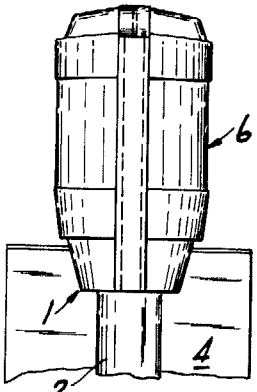
FIG. 3 is a similar elevational view from the aft end taken generally on line 3—3 of FIG. 1 and showing the aft elevational construction of the upper power head.

Referring to the drawings and particularly to FIGS. 1 – 5, the present invention is illustrated applied to an outboard motor including an upper powerhead 1 secured to a driveshaft housing 2. A swivel bracket assembly 3 releasably secures the outboard motor to the transom 4 of a boat, not otherwise shown, to properly locate a lower propeller unit, not shown, for propulsion of the watercarft through water or over a water body. The powerhead 1 includes an internal combustion engine 5 supported on the upper end of driveshaft housing 2 and including a separate driveshaft, not shown, extended downwardly through the driveshaft housing 2. The engine 5 is enclosed within a cowl assembly or unit 6 which is specially constructed in accordance with the teaching of the present invention for convenient assembly and disassembly with respect to the driveshaft housing 2 and engine 5. Generally, the illustrated cowl assembly 6 of the present invention includes a pair of generally similar cowl members including a port cowl member 7 and a starboard cowl member 8. The cowl members 7 and 8 are independently supported upon engine 5 and, in particular, are hingedly mounted to a rear mounting bracket 9 which, in turn, is suspended from the engine 5 by a suitable vibration isolating rubber mount 10 such as those disclosed in U.S. Pat. No. 3,358,668. The aft ends of the cowl members 7 and 8 overlap a rear sealing bracket 11 which is a flat, narrow plate-like member and is attached to the mounting plate 9 as more fully developed hereinafter to provide a continuous, pleasing aft appearance of the outboard motor, for example, as illustrated in FIG. 3.

Figure 1:
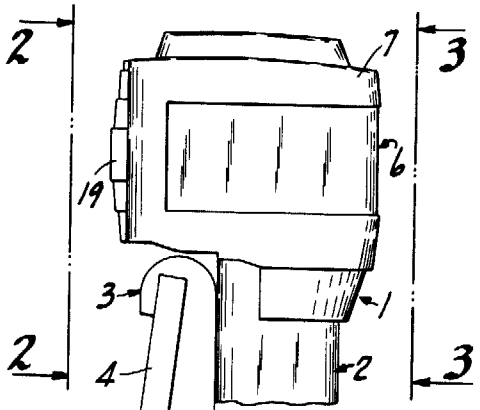
FIG. 1 is a simplified side elevational view of the upper power head portion of an outboard motor constructed in accordance with the present invention.

The cowl members 7 and 8 overlap at the center and enclosed the opposite halves of the engine 5 in the closed position. Each cowl member 7 and 8 similarly includes a skirt portion 12 which extends downwardly about the upper end of the exhaust housing 2 and is releasably sealed thereto to maintain essentially complete enclosure of the engine 5. The cowl members 7 and 8 are suspended at the forward end upon a silencing wall or plate 13 secured to the front of the internal combustion engine 5. In particular a top mounting bracket 14 is secured by a pair of suitable isolating mounts 15 to the upper end of the silencing wall 13 and provide a support for the upper forward end of the cowl members 7 and 8. A front latch bracket or support unit 16, similar to that shown in U.S. Pat. No. 3,773,010, is secured by isolating rubber mounts 17 to the lower end of the silencer wall 13 and includes means to provide a support for the forward end of the cowl members 7 and 8, as hereinafter developed. The forward ends of the cowl members 7 and 8 are secured to each other, generally as shown in U.S. Pat. No. 3,773,010. Generally, in the closed cowl position, the forward edges of the cowl members 7 and 8 are laterally spaced with a pair of vertically spaced clamp units 18 for releasably interconnecting of the cowl members 7 and 8. A separate front cover 19, as illustrated in FIGS. 1 and 2, is secured overlying the spaced front cowl edges to maintain a complete aesthetically pleasing powerhead enclosure. A mechanical latch assembly 20 forming a part of the lower front support unit 16 is provided for releasable latching of the front cover 19 in place.

In accordance with conventional practice, the inner wall surface of the cowls 7 and 8 will be lined with a suitable sound deadening material or pad means to absorb noise and the like.

The present invention is particularly directed to the construction of the cowl assembly 6 including the separate port and starboard cowl members 7 and 8, and more particularly to a novel mounting of such separate cowl members to permit convenient installation and removal from the front of the outboard motor. Thus the cowl members 7 and 8 and their interconnecting are particularly described hereinafter. The other portions of the outboard motor are not further described as they may, of course, be of any suitable or desired construction.

Furthermore, as the cowl members 7 and 8 are generally similarly formed, the starboard cowl member 8 and its mounting is described in detail with the corresponding elements of the port cowl 7 identified by similar primed numbers.

Referring particularly to FIGS. 4 and 7 – 9, the cowl member 8 generally includes a slightly curved sidewall 22 integrally formed with an inwardly extended rear wall 23 and an inwardly extended front wall 24. A top wall 25 is integrally formed with the side, rear and front walls and projects over the engine 5 into telescoped sealing relation to the top wall 25' of the cowl member 7. A partial bottom wall 26 is integrally formed forwardly of the skirt 12 to complete the enclosure about the internal combustion engine 5.

The cowl 8 is pivotally mounted by a hinge means independently of a similar pivotal mounting of cowl member 8 to the aft end of the engine 5 upon rear mounting bracket 9. In the illustrated embodiment of the invention, upper and lower hinge pin units 30 and 31 are secured to the cowl rear wall 23 in appropriately vertically spaced relation for mating with a pair of similarly spaced socket or receptacle units 32 and 33 secured to the starboard side of the back mounting plate 9.

Figure 7:
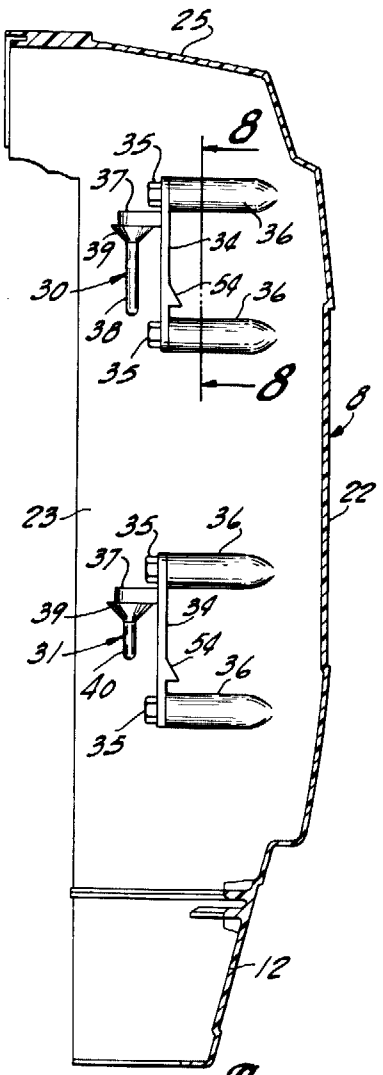
FIG. 7 is a vertical section taken generally on line 7—7 of FIG. 6.
Figure 8:
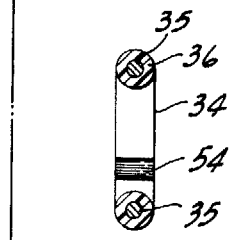
FIG. 8 is a view taken generally on line 8—8 of FIG. 7, and showing the hinge pin structure.

Referring particularly to FIGS. 7 and 8, the upper mounting pin unit 30 includes a mounting base plate or strip 34 secured by a pair of opposite end bolts 35 to a pair of appropriately spaced hubs 36 integrally cast on the rear wall 23 of the cowl member 8. The plane of the base plate 34 is generally parallel to the front to back plane of the engine. A support arm 37 projects laterally of the engine with a depending pin 38 on the outer end. The pin 38 includes an upper head 39 of a conical configuration.

The lower mounting pin unit 31 is similarly constructed but the interrelated pin 40 is of a significant shorter length.

The pins 38 and 40 are located within the correspondingly spaced socket units 32 and 33 which are mounted in correspondingly spaced relation on plate 9.

Figure 11:
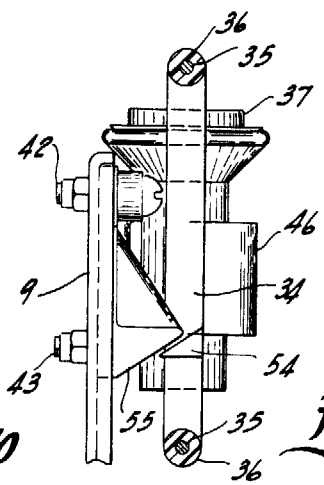
FIG. 11 is a side elevational view taken of FIG. 10.
Figure 12:
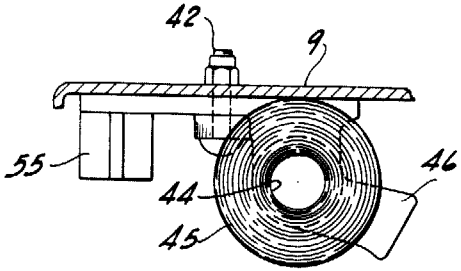
FIG. 12 is a top elevational view of FIG. 10.
Figure 10:
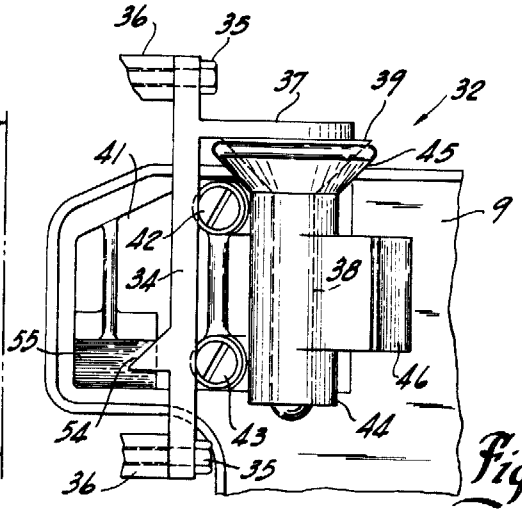
FIG. 10 is an enlarged elevational view of the upper hinge pin and receptacle and taken generally along the line 10—10 of FIG. 4.
Figure 9:
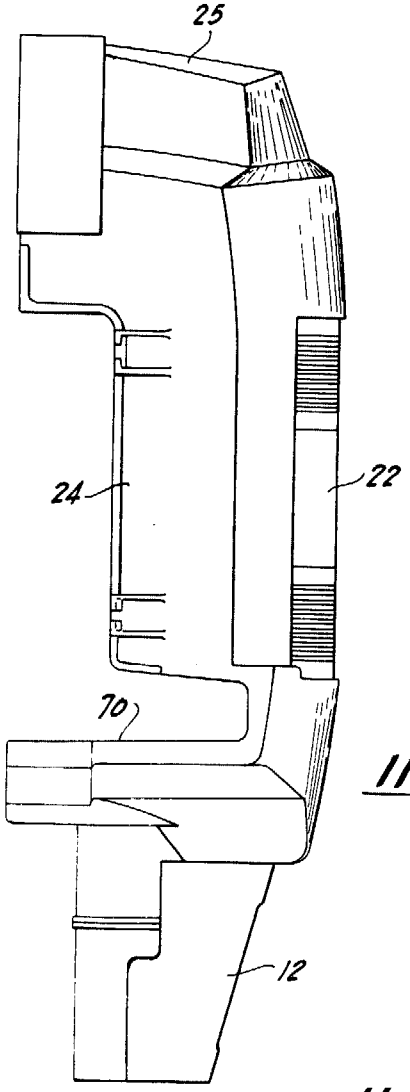
FIG. 9 is a front end view of the starboard cowl member and taken generally on line 9—9 of FIG. 6.

Referring particularly to FIGS. 10 – 12, the upper mounting socket unit 32 includes a mounting plate-like base 41 which is secured to the plate 9 to one side of bracket 11 by a pair of suitable nut and bolt units 42 and 43 to rigidly and firmly mount the socket unit in fixed relation to the engine. A tubular socket 44 is integrally cast with the base 41 and includes an upper conical head 45 complementing the conical head 39 of the hinge pin 38. With the hinge pin 38 generally aligned with the enlarged opening defined by the conical head 45, the lowering of the cowl 8 provides for guided movement of the pin 38 into the socket 44.

In addition, the socket unit 32 includes an edge guide wall or cam 46 which projects laterally toward the sealing bracket 11 and defines a vertically inclined wall 47 spaced slightly therefrom.

The rear mounting plate 9 is generally a planar member including an outwardly curved central wall portion 48 with the rear sealing bracket 11 secured thereto by a plurality of bolt members 49 which extend rearwardly through the mounting plate. The seal bracket 11 is rearwardly spaced from the mounting plate 9 by appropriate aligned hub portions 50 and 51 on the respective members, to locate the seal bracket 11 in the rearwardly spaced relation to the rear mounting plate 9 and particularly socket units 32 and 33. To assemble the cowl 8, the back edge 52 of the cowl 8 is moved into the opening 53 between the face of a cam 46 and the adjacent edge of the seal bracket 11. The cowl 8 is pivoted outwardly approximately ten degrees and moved inwardly till the pin 38 generally overlies the socket 45 which is clearly visible over the top of engine 5, from the forward end of the outboard motor 1. The cowl 8 is then lowered with the upper guide pin 38 first moving into visible socket 44 and automatically providing guided movement of the lower shorter pin 40 into its socket unit 33. The present invention thus provides convenient alignment of the upper portion of the cowl 8 which is readily visible and in combination with the edge guide and lower socket unit providing automatic alignment at the lower end permitting convenient and reliable coupling of both the upper and lower hinge pin assemblies. The cowl 8 is then pivoted on the hinge pin assemblies to the closed position. The cowl 7 is similarly mounted to the opposite side of the engine 5.

Further, in the illustrated embodiment of the invention a mechanical hold-down or latch unit is automatically established as the cowl 8 is pivoted to the closed forward position to hold the cowl 8 against upward movement while in the closed position. Referring particularly to FIGS. 7 – 12, the pin unit 30 is shown in detail and includes a latch member 54 which projects rearwardly from the base 34 generally adjacent to the lower end of the pin 30. The upper face of member 54 is on an inclined plane. The socket unit 32 includes a complementing latch member 55 integrally formed to the base 41 in outwardly spaced relation to the tubular socket 44. The member 55 is located immediately above the lower end of the socket 44 and the lower face is an inclined plane. With the cowl 8 pivoted to the assembling position and lowered with the pin unit 30 mating with the socket unit 32, the latch member 54 on the pin unit will move downwardly past and immediately below the socket latch member 55. When the cowl 8 is pivoted to the closed position, the pin latch member 54 moves beneath the socket latch member 55 with the inclined planes producing a downward clamping force on the cowl member 54 to provide a positive holddown on the cowl 8. The other hinge and socket assemblies for cowls 7 and 8 include similar latch means.

To complete the rear connection, the upper end of the seal bracket 11 is provided with an inwardly projecting ledge 56. The upper aft end of the top wall 25 of the cowl 8 projects over the ledge 56 to further support the cowl 8.

The forward end of the cowl 8 is also suspended to the front end of the engine 5 by a pair of vertically spaced support pins 57 and 58 which releasably mate with a pair of oval-shaped support rings 59 and 60. The pins 57 and 58 are firmly secured within suitable formed bushings 61 and 62 on the top and bottom walls of the cowl, as most clearly shown in FIGS. 6, 15 and 16.

More particularly, the upper mounting U-shaped bracket 14 is secured to the top of the plate with the oval-shaped rings 59 and 59' formed at the opposite end thereof for suspension of the respective cowls 7 and 8. The oval-shaped rings 59 are provided with rubber bushings 63 to provide further vibrational isolated mounting of the cowl 8. The oval-shape of the ring 59 accommodates the limited ten degree movement of cowl 8 between the latched and released positions of cowl 8.

Figure 5:
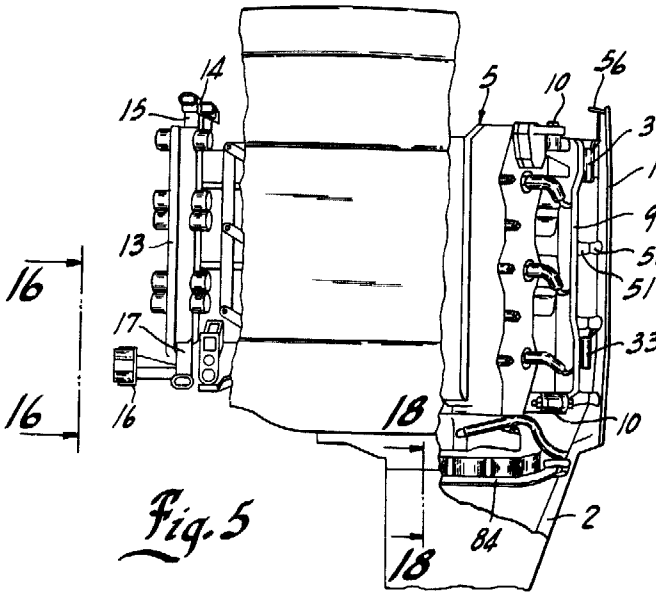
FIG. 5 is a slightly enlarged side elevational view with the forward and aft cowl ends broken away to show the engine mounting structures.

The lower portion of the cowls 7 and 8 are similarly suspended in the bottom oval-shaped rings 60 and 60' integrally connected to the lower latch unit 16, as shown in FIGS. 5 and 16. The illustrated latch unit 16 includes a centrally located plate-like support 64 secured to the lower edge of the silencer wall 13 by a pair of isolating rubber mounts 65. The conventional cover latch lever 66 is secured to the central portion and includes suitable latch means adapted to mate with latch elements on the front cover 19 such as shown in U.S. Pat. No. 3,773,010. Integrally cast to the opposite sides of the plate-like support 64 are arms 67 which extend outwardly slightly and terminate in the oval-shaped ring 60. The pins 58 are suitably attached to the bottom wall 26 of cowl 8 with the pin 58 aligned with the oval-shaped ring 60 when cowl 8 has been lowered to properly mater the rear hinge pin assemblies. The oval construction of rings 60 also accommodate a slight pivotal movement required to assembly the cowl 8. The front latch unit 16 further includes a pair of laterally extending closure plates 68 and 69 located immediately forwardly of the supporting hinge rings 60 and 60' and each defining a generally vertical wall portion of the front wall 24 of cowl 8. The front wall 24 in particular includes an edge recess 70 which mates with the plate 68, as most clearly shown in FIGS. 6 and 16. A clamp pad 71 is secured within an edge receptacle or chamber on the outermost edge of the closure plate 68. A throttle cable 72 is mounted in abutting engagement with the outwardly projecting clamping pads 71. A similar clamping pad 73 is secured within a cover pocket 74 on the inner wall of the cowl 8 as most clearly shown in FIG. 16. In the assembled relation the adjacent clamping pads 71 and 73 firmly, resiliently and releasably support the throttle cable 72 in place.

The opposite or port cowl 7 and the plate 69 is similarly constructed. Plate 69 is also provided with an edge recess 75 and the cowl 7 is provided with a similar edge recess 76 to accommodate a fuel line 77 which is firmly and resiliently held in place. The front plate may also be provided with a power cable opening 78 permitting the interconnection of a suitable power cable 79 therethrough for interconnection of the several required power complements.

With the cowls 7 and 8 firmly interconnected by the overcenter type clamps 18, the fuel-line 77 and the throttle cable 72 are firmly affixed in position simultaneously with the corresponding clamping of the cover in place.

The opposed edges of cowls 7 and 8 telescope in the assembled relation to provide a continuous wall appearance. In the illustrated embodiment, the edge of the cowl 8 includes a recess 80 formed in the outermost edge of the top wall 25 and the port cowl 7 includes an inwardly projecting lip 81 adapted to mate therewith to form the seal with a centrally located upper ridge. A resilient seal member or element 82 is located within the base of the recess 80 to form a generally liquid tight seal.

Figure 6:
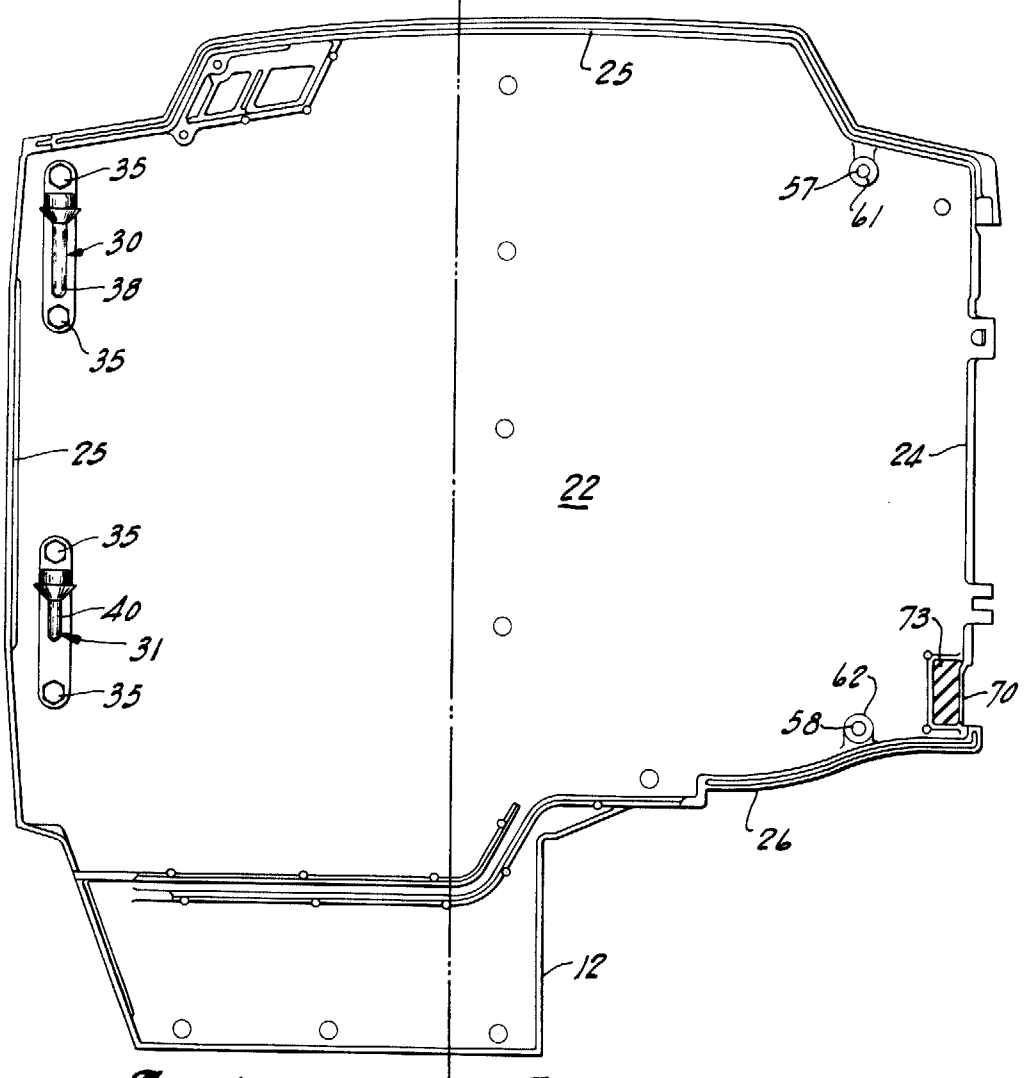
FIG. 6 is an enlarged elevational view of the starboard cowl member looking into the cowl structure.
Figure 13:
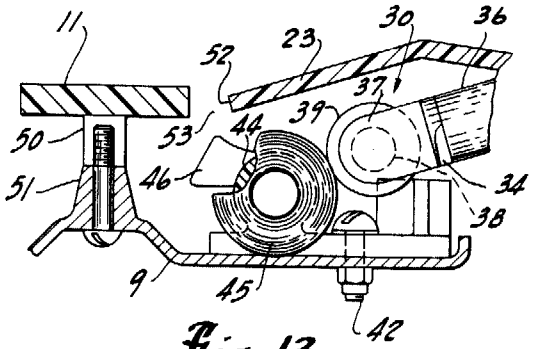
FIG. 13 is a view similar to FIG. 12 illustrating the starboard side mounting, with the cover positioned for introduction into overlapping positioning into the hinging position.

The bottom wall 26 forwardly of the skirt 12 and thus generally forwardly of the drive shaft housing 2 is similarly formed with a telescopic seal assembly, as shown in FIGS. 6 and 16.

As shown in FIG. 18, the skirt portion 12 depends downwardly about the driveshaft housing 2 with an encircling recess 83 adapted to be aligned and mate with a lip portion 84 on the driveshaft housing 2. Thus, as the cowl members 7 and 8 are pivoted to the closed position, the telescopic seal about the driveshaft housing 2 is completed and further firmly supports the cowl structure and simultaneously effects an essentially complete enclosure of the engine, thereby further minimizing noise transmission to the surrounding environment.

In summary, the individual and independent cowl members 7 and 8 are separately and similarly suspended on the engine with the unique upper visible hinge assembly providing piloting movement of the lower support into proper engagement.

The invention thus provides a reliable and convenient cowl apparatus for a high horsepower outboard motor.

Various modes of carrying out the invention are contemplated as being within the scope of the following claims, particularly pointing out and distinctly claiming the subject matter which is regarded as the invention.

I claim:

1. A cowl assembly for enclosing the engine of an outboard motor, comprising a port cowl member, a starboard cowl member, a port hinge assembly, a starboard hinge assembly, each of said hinge assemblies having a first hinge means on the cowl member and a second releasable hinge means adapted to be mounted on said engine with a generally vertical pivot axis, said port and starboard hinge assemblies being constructed and arranged to independently and separately support said port and starboard cowl members on said engine, said first and second hinge means consisting of sole interconnecting means for directly establishing supporting pivot engagement by vertical movement of said cowl member and for directly establishing non-supporting pivot disengagement by vertical movement of said cowl member and permitting removal of one cowl member from the engine without removal of the other cowl member.

2. The cowl assembly of claim 1 wherein said first hinge means is separable from said second hinge means by upward movement of said corresponding cowl member vertically.

3. A cowl assembly for enclosing the engine of an outboard motor, comprising a port cowl member, a starboard cowl member, a port hinge assembly, starboard hinge assembly, each of said hinge assemblies having a first hinge means on the cowl member and a second releasable hinge means adapted to be mounted on said engine with a generally vertical pivot axis, means connecting said first and second hinge means for directly establishing engagement by vertical movement of said cowl member and for establishing disengagement by vertical movement of said cowl member, said port and starboard hinge assemblies being constructed and arranged to independently and separately support said port and starboard cowl members on said engine, said first and second hinge means being releasably constructed with hinged supporting engagement and with disengagement from said supporting engagement in response to predetermined movement of a cowl member for removal of one cowl member from the engine without removal of the other cowl member including a releasable hold-down latch means including an engine mounted member and a cowl mounted member, said latch means being engaged in response to pivoting of said cowl member about the vertical pivot axis to closed position.

4. A cowl assembly for enclosing the engine of an outboard motor, comprising a port cowl member, a starboard cowl member, a port hinge assembly, starboard hinge assembly, each of said hinge assemblies having a first hinge means on the cowl member and a second releasable hinge means adapted to be mounted on said engine with a generally vertical pivot axis, means connecting said first and second hinge means for directly establishing engagement by vertical movement of said cowl member and for establishing disengagement by vertical movement of said cowl member, said port and starboard hinge assemblies being constructed and arranged to independently and separately support said port and starboard cowl members on said engine, said first and second hinge means being releasably constructed with hinged supporting engagement and with disengagement from said supporting engagement in response to predetermined movement of a cowl member for removal of one cowl member from the engine without removal of the other cowl member, said first hinge means is separable from said second hinge means in response to upward movement of said corresponding cowl member vertically, a releasably hold-down latch means including an engine mounted member and a cowl mounted member, said latch means being engaged in response to pivoting of said cowl member about said vertical pivot axis to closed position.

5. The cowl assembly of claim 2 wherein said second hinge means includes an edge guide means for the rear wall of said corresponding cowl member to guide the cowl member during lifting and lowering of the cowl member.

6. A cowl assembly for enclosing the engine of an outboard motor, comprising a port cowl member, a starboard cowl member, a port hinge assembly, starboard hinge assembly, each of said hinge assemblies having a first hinge means on the cowl member and a second releasable hinge means adapted to be mounted on said engine with a generally vertical pivot axis, means connecting said first and second hinge means for directly establishing engagement by vertical movement of said cowl member and for establishing disengagement by vertical movement of said cowl member, said port and starboard hinge assemblies being constructed and arranged to independently and separately support said port and starboard cowl members on said engine, said first and second hinge means being releasably constructed with hinged supporting engagement and with disengagement from said supporting engagement in response to predetermined movement of a cowl member for removal of one cowl member from the engine without removal of the other cowl member, said first hinge means is separable from said second hinge means by upward movement of said corresponding cowl member vertically, each of said hinge assembly includes an upper hinge unit and a lower hinge unit, said upper hinge unit being visible from the front of the outboard motor in the placement of the cowl member to the engine.

7. The cowl assembly of claim 6 wherein each of said first and second hinge means include a pin means and a socket means, the cowl mounted hinge means having a longer upper hinge means than lower hinge means to establish engagement of the upper hinge unit before engagement of the lower hinge unit whereby said upper hinge serves as a pilot for the lower hinge unit.

8. The cowl assembly of claim 7 wherein said pin means is mounted on said cowl member and said socket means is mounted on said engine, said pin means and socket means having complementing conical-shaped heads.

9. The cowl assembly of claim 7 wherein said pin means and said socket means include a pair of vertically overlapping interfering latch members with the cowl member in the closed position to hold the cowl down, said cowl mounted latch member pivoting outwardly from the engine mounted latch member to permit lifting of the cowl member.

10. The cowl assembly of claim 9 wherein said interfering latch members have engaging inclined walls to cam the cowl member downwardly.

11. The cowl assembly of claim 1 including separate front port and starboard cowl suspension assemblies for individually resiliently supporting the cowl members, each of said suspension assemblies including a first suspension means on the cowl member and a second releasably engageable suspension means adapted to be resiliently mounted upon said engine, said suspension means being disengaged in response to outward pivoting of the cowl member.

12. The cowl assembly of claim 11 wherein each of said suspension assemblies includes a pair of vertically spaced suspension units, each of said units including a pin means and an oval-shaped socket means, said socket means having a vertical minor axis essentially corresponding to said pin means and a horizontal major axis of sufficient length to allow disengagement of the pin means with pivoting of the cowl member.

13. The cowl assembly of claim 12 wherein said pin means are secured to the cowl member and said socket means are adapted to be secured to the engine.

14. In an outboard motor having an upper powered unit including an internal combustion engine secured to an upper end of a dependently supported driveshaft housing, the improvement in a cowl assembly enclosing said engine, comprising a starboard cowl member, a port cowl member, each of said cowl members including a sidewall, a rear wall, a front wall and a top wall to enclose a corresponding portion of the engine, vertically separable hinge means interconnected to said rear wall and to said engine to independently hingedly mount each of said cowl members to the aft end of the engine, said first and second hinge means consisting of sole interconnecting means for directly establishing supporting pivot engagement by vertical movement of said cowl member and for directly establishing non-supporting pivot disengagement by vertical movement of said cowl member and permitting each of said cowl members being separate from the opposite cowl and movable vertically, upwardly from the hinged position, said hinge means being visible from the front of the outboard motor in the placement of the cowl members to the engine, and a releasable front suspension means coupling the front wall of the cowl members to the front end of the engine.

15. In the outboard motor of claim 14 wherein said rear walls of said starboard and port cowl members are mounted in aligned, laterally spaced relation in the closed cowl position, and a sealing bracket secured to the engine and overlying the aft end of the rear walls.

16. In the outboard motor of claim 14 having a rear mounting cowl frame assembly including a plurality of spaced resilient mounts connected to said engine to vibrationally isolate the frame assembly in mounted relation to the engine, said hinge means including a first plurality of hinge members secured to the port side of said frame assembly and a second similar plurality of vertically spaced hinge members secured to the starboard side of said frame assembly, the uppermost hinge member being visible from in front of the motor, said port cowl member including vertically spaced upper and lower hinge members secured to the rear wall and aligned with the corresponding port hinge members of the frame assembly, said port hinge members on said frame assembly and said cowl member being releasably interconnected by vertical movement of the port cowl member, the uppermost hinge members being constructed to engage prior to the other hinge means during lowering of the cowl members, said starboard cowl member having corresponding hinge members releasably, hingedly connected to the hinge members to the starboard side of the frame assembly.

17. The motor of claim 16 wherein said hinge members include interlocking pin members and socket members having enlarged guide heads.

18. The motor of claim 17 having said socket member secured to the engine, said socket member including a conically shaped upper opening and a tubular extended pin opening, a guide wall secured to said engine and located to define a guide for the back wall of the cowl during the lowering thereof, said uppermost socket member being visible from in front of the outboard motor, said cowl hinge members including a plurality of correspondingly spaced pin members, the uppermost pin member being significantly longer than the lowermost pin members.

19. The motor of claim 18 including a pin mounting bracket secured to the cowl and said pin members, a first latch member secured to the mounting bracket opposite said pin members, an interlocking latch member secured to the socket member spaced laterally outwardly of the socket member, and said latch members being located in immediately adjacent stacked relation with the hinge assembly completed and the cowl member pivoted to the closed position.

20. The motor of claim 16 wherein said hinge means include a socket member secured to the engine, said socket member including a conically shaped upper opening and a tubular extended pin opening, a cam locating wall secured to said socket unit and located in spaced relation to the back sealing bracket to define a guide opening for the back wall of the cowl, said socket members including an uppermost socket readily visible from the front of the outboard motor, said cowl hinge members including a plurality of correspondingly spaced pin members, the uppermost pin member being significantly longer than the lowermost pin members, and a pin mounting bracket secured to the cowl and said pin members.

21. The motor of claim 20 including a first latch member secured to the mounting bracket opposite said pin members, an interlocking latch member secured to the socket member spaced laterally outwardly of the socket member, and said latch members being located in immediately adjacent stacked relation with the hinge assembly completed and the cowl member pivoted to the closed position.

22. The outboard motor of claim 14 having a silencer wall secured to the front of said engine, a top suspension bracket resiliently secured to the upper end of the silencer wall by a plurality of spaced resilient mounts, said bracket terminating at the opposite end in aligned laterally spaced oval rings laterally of the port and starboard cowls, said port and starboard cowl front suspension means having suspension pin members aligned with said oval-shaped second ring members and supporting said cowl members, said oval rings having a major horizontal axis and a minor axis corresponding to the suspension pin members, said starboard and port cowl members being pivoted outwardly with the suspension pins moving in the oval ring to disengage therefrom and release the front end of the cowl members.

23. The outboard motor of claim 14 having a silencer wall secured to the front of the engine, a lower front plate secured to the lower end of the silencer wall by a plurality of spaced resilient mounts, the lower front walls of said port and starboard cowl members having edge openings mating with said walls, clamping pads located between the lateral outer edges of the wall and the adjacent portion of the cowl member, connecting elements located between said pads and physically clamped in position in response to the interconnection of the forward end of the cowl members.

24. The outboard motor of claim 14 wherein said forward ends of said starboard and port cowl members are spaced laterally of each other, a separate front cover releasably interconnected in overlying relationship to the front walls, said top wall including a tongue and groove connection to provide a continuous sealed top wall, said cowl members including depending skirt portions aligned with the driveshaft housing, said cowl members including a partial bottom wall located immediately forwardly of the driveshaft housing skirt portion and including tongue and groove edge connection to seal the cowl forwardly of the driveshaft housing, said skirt portion depending downwardly and having a seal recess, a lip covered with a resilient material formed on the driveshaft housing and projecting into said seal recess to seal the lower end of the cowl about the driveshaft housing, said cowl being thereby vibrationally isolated from the engine and driveshaft housing while maintaining a noise enclosure of the engine.

25. In an outboard motor having a driveshaft housing and an engine secured to the upper end of said housing, a rear mounting cowl frame assembly including a plurality of spaced resilient mounts connected to said engine to vibrationally isolate the frame assembly in mounted relation to the engine, a first plurality of hinge members secured to the port side of said frame assembly, a second similar vertically spaced plurality of hinge members secured to the starboard side of said frame assembly, a port cowl member and a starboard cowl member enclosing the port and starboard sides of said engine and the adjacent driveshaft housing portion and being slightly spaced therefrom, said port cowl member including vertically spaced upper and lower hinge members secured to the rear wall and aligned with the corresponding port hinge members of the frame assembly, said port hinge members on said frame assembly and said cowl member being releasably interconnected by vertical movement of the port cowl member, said starboard cowl member having corresponding hinge members releasably hingedly connected to the hinge members to the starboard side of the frame assembly, a silencer plate secured to the front of said engine, a top suspension bracket resiliently secured to the upper end of the silencer wall by a plurality of spaced resilient mounts, said bracket terminating in at the opposite end in aligned laterally spaced oval ring openings laterally of the port and starboard cowls, said port and starboard cowls having suspension pin members aligned with said oval-shaped second ring members and supporting said cowl members, said oval rings having a major horizontal axis and a minor axis corresponding to the suspension pin members, said starboard and port cowl members being pivoted outwardly with the suspension pins moving in the oval ring members to disengage therefrom and release the front end of the cowl members, a lower front plate secured to the lower end of the silencer wall by a plurality of spaced resilient mounts, the lower front walls of said port and starboard cowl members having edge openings mating with said walls, clamping pads located between the lateral outer edges of the wall and the adjacent portion of the cowl member, connecting elements located between said pads and physically clamped in position in response to the interconnection of the forward end of the cowl members, said forward ends of said starboard and port cowl members being spaced laterally of each other, a separate front cover releasably interconnected in overlying relationship to the front walls, said top wall including a tongue and groove connection to provide a continuous sealed top wall, said cowl members including a partial bottom wall located generally forwardly of the driveshaft housing skirt portion and including tonge and groove edge connection to seal the cowl forwardly of the driveshaft housing, said skirt portion depending downwardly and having a seal recess, a lip covered with a resilient material formed on the driveshaft housing an projecting into said seal recess to seal the lower end of the cowl about the driveshaft housing, said cowl being thereby vibrationally isolated from the engine and driveshaft housing while maintaining an essentially complete noise dampending enclosure of the engine.

26. An outboard motor cowl assembly comprising a cowl member having a sidewall with inwardly extended front and rear walls, a pair of vertically spaced rear hinge means fixedly secured to said back wall and each including an upper support extending parallel to the back wall and a vertically depending fixed pin secured to the support and extending downwardly therefrom, and a pair of vertically spaced front pin means fixedly secured to the front wall and each including a horizontally inwardly extending fixed pin located rearwardly of the front wall.

27. The outboard motor cowl assembly of claim 26 including a rear supporting plate having a pair of vertically extended socket units spaced in accordance with said pins of said rear hinge means, a seal bracket secured to the plate in outwardly spaced relation to the socket units and overlying the edge of the back wall with the cowl supported within the socket units.

28. The cowl assembly of claim 27 wherein said pins of said rear hinge means and said socket units include interferring elements permitting pivotal movement therebetween and restricting upward movement of the cowl member.

29. The cowl assembly of claim 26 including a front supporting means having a pair of oval-shaped rings vertically spaced in accordance with the pins on the front wall, said rings having a horizontal major axis extending essentially parallel to the sidewall.

* * * * *